US005288383A

United States Patent [19]

Sparwald et al.

[11] Patent Number: 5,288,383

[45] Date of Patent: Feb. 22, 1994

[54] METHOD AND APPARATUS FOR ADJUSTING THE DISTANCE BETWEEN THE POLES OF ELECTROLYSIS CELLS

[75] Inventors: Volker Sparwald, Grevenbroich; Gerald Peychal-Heiling, St. Augustin, both of Fed. Rep. of Germany

[73] Assignee: VAW Aluminum Aktiengesellschaft, Bonn, Fed. Rep. of Germany

[21] Appl. No.: 491,475

[22] Filed: Mar. 8, 1990

[30] Foreign Application Priority Data

Mar. 10, 1989 [DE] Fed. Rep. of Germany ..... 3908087

[51] Int. Cl.[5] ..... C25C 3/10; C25C 3/12; C25B 9/00

[52] U.S. Cl. ..... 204/225; 204/245; 204/286

[58] Field of Search ..... 204/225, 243 R, 244–247, 204/286

[56] References Cited

U.S. PATENT DOCUMENTS

| | | | |
|---|---|---|---|
| 3,219,570 | 11/1965 | Wunderli | 204/225 |
| 3,410,786 | 11/1968 | Duclaux et al. | 204/245 X |
| 3,575,827 | 4/1971 | Johnson | 204/225 X |
| 3,687,398 | 9/1972 | Caleffi | 204/225 X |
| 3,752,465 | 8/1973 | Siegmund | 204/286 X |
| 4,448,660 | 5/1984 | Fabian | 204/225 |
| 4,816,129 | 3/1989 | Sandvik | 204/225 X |

*Primary Examiner*—Donald R. Valentine
*Attorney, Agent, or Firm*—Darby & Darby

[57] ABSTRACT

A method and apparatus for adjusting the distance between the anodes and cathodes in an electrolysis cell includes first and second anode beams, movably disposed in an upper and lower relationship. The anode beams are interconnected by a spindle having upper and lower portions which are oppositely threaded such that rotating the spindle in a first direction moves the beams towards each other and rotating the spindle in the other direction moves the beams away from each other. Cell anodes are selectively attached to one of the anode beams, dependant on the desired direction of adjustment. By attaching the anodes to one or the other anode beam, as they are cycled towards and away from each other, individual anode adjustment in either direction can be achieved. If desired, an essentially constant downward motion may also be provided, without requiring a halt in cell operation. Consequently, cell efficiency is increased and the cell remains on-line for longer periods, increasing production capacity.

13 Claims, 3 Drawing Sheets

METHOD AND APPARATUS FOR ADJUSTING THE DISTANCE BETWEEN THE POLES OF ELECTROLYSIS CELLS

TECHNICAL FIELD

The invention is directed to a method and apparatus for adjusting the distance between the poles of electrolysis cells, and more particularly to electrolysis cells which have an anode suspended from a movable anode beam, such as those cells used for the electrolysis of molten aluminum.

BACKGROUND OF THE INVENTION

The electrolysis process for producing aluminum is well-known. The process uses an electrolysis cell having a number of anodes and cathodes. By passing a current through a raw material such as alumina located between an anode and a cathode, molten aluminum is produced. Once molten, essentially pure aluminum metal is withdrawn. In such cells, the cathodes are usually fixed and cooperate with a number of movable carbon-based anodes which are consumed during the electrolysis process. Carbon is used because it can be consumed without adding impurities to the product aluminum. To maintain optimum conditions, i.e., minimize power consumption, the spacing or gap between the cathode and anode should be maintained at an essentially constant distance. Thus, as the carbon anode is consumed, the gap increases and the anode must be lowered to maintain the optimum gap.

For ease in illustration, a single anode/cathode pair will be discussed. Typically, the anode has an upwardly extending rod which is attached to a movable anode beam. The anode is thus suspended from the beam which controls the movement of the anode. The anode beam is in turn engaged by a mechanism for raising or lowering the anode beam. Thus, the anode beam is lowered in an amount corresponding to the consumption of the carbon anode. When the anode beam reaches its lowest point, each anode is individually attached to an auxiliary cross arm, which is mounted on an end-side supporting frame. The locks holding the anodes to the beam are then released, and the anode beam is raised to its highest position. The anodes are then reattached to the beam for further lowering. Of course, such a procedure requires a halt to production, and, to minimize these stoppages, a long anode rod and a large difference in anode beam travel.

Following this method, the difference between the highest and lowest positions of the anode beam is fairly large, on the order of 250–400 mm (25–40 cm), resulting in a large current path with a consequent high power loss. Another result of the large amount in the beam travel is a fluctuation in the magnetic field around the cell which may disrupt cell efficiency. Also, it is quite time consuming to detach and reattach the anodes to the anode beam.

Ideally, the distance between poles (distance from the underside of the anode to the cathode) is the same for all anode carbons, and the electrolysis current distributes itself uniformly over all anode carbons. In operation, however, deviations from the ideal case occur, as each anode is consumed at a varying rate, and this deviation must- be corrected to prevent the scatter of the current distributions over the anodes from exceeding a certain limit with a loss in efficiency. To correct this deviation, the pole spacing of individual anode carbons must be increased or decreased to account for the deviations in consumption.

Another problem with electrolysis cells involves changes in efficiency due to changes in the electrolyte. Upon aluminum oxide depletion from the electrolyte, the so-called "anode effect" occurs, where, during the anode effect, the furnace voltage demand increases from about 4 V to about 30 V. This voltage rise causes greater energy consumption and therefore must be eliminated quickly. To eliminate the anode effect, aluminum oxide is added to the electrolyte, increasing the bath volume. It is common practice that all anode carbons are moved up from the metal bath to prevent local shortcircuiting during the addition. During return of the anodes to there optimum spacing, the downward movement of the anode carbons may cause overflow of the melt due to displacement of the metal bath.

SUMMARY OF THE INVENTION

It is an object of the present invention to provide a method and apparatus to limit the travel of the anode beam.

It is another object of the present invention to provide a method and apparatus for readjusting the distance between the anode and cathode which does not require use of an auxiliary cross arm.

It is another object of the present invention to provide a method and apparatus for adjusting each individual anode accurately, relative to the particular amount of anode consumption.

It is yet another object of the present invention to provide a method and apparatus for readjusting the position of an anode beam quickly and easily while maintaining a minimized distance between the highest and lowest beam positions.

These and other objects of the present invention are achieved by an apparatus for adjusting the distance between the anodes and cathodes of electrolysis cells, comprising:

a first movable anode beam, to which individual anodes are attachable, a second movable anode beam, disposed beneath the first anode beam, to which individual anodes are attachable, means for selectively attaching individual anodes to either one of the first or the second anode beams, dependent on the direction in which the individual anode is to be moved, and, means for moving the anode beams relative to each other, the beams being synchronously movable in a first direction towards each other and in a second direction away from each other, such that the correspondingly attached anodes are raised or lowered as desired. Preferably, the beams move through a cycle where they travel first towards each other, then away from each other such that one of the anode beams is always moving in a downward direction, and one is always moving in an upward direction. Thus, by alternately attaching the anode rods to the anode beam which is moving downwardly, the anode achieves a continuous downward motion which compensates for the anode consumption. Of course, where an individual anode needs to be raised, it is attached alternately to the anode beam moving upwardly.

DETAILED DESCRIPTION OF THE INVENTION

Figure 1:
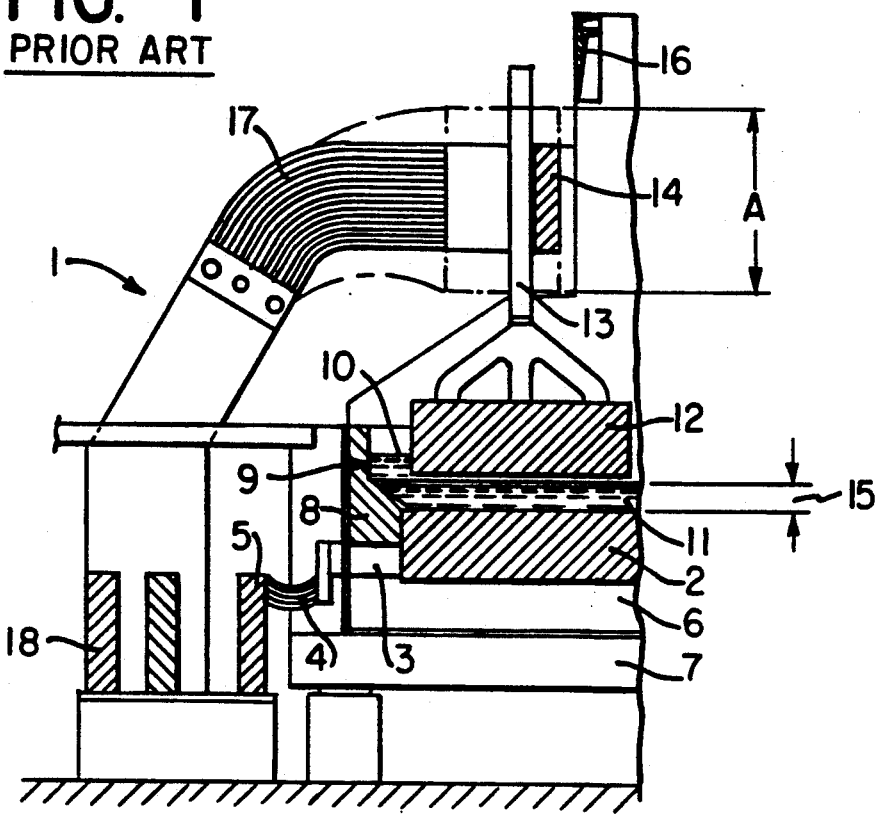
FIG. 1 PRIOR ART
FIG. 1 is an illustrative view of a prior art electrolysis cell.

Referring to FIG. 1, a prior art electrolysis cell 1 is shown. An electrolysis cell for producing aluminum is discussed for illustrative purposes only, as any electrolysis cell having one or more movable anodes or cathodes could utilize the present invention.

The cell 1 has a cathode 2 made of carbon connected by a rigid conductor 3 and a flexible conductor 4 to a cathode buss bar 5. Below the cathode carbons is a layer 6 of thermal insulation. A steel structure 7 forms the outer jacket of the cell. The cell includes a carbon lining 8 which surrounds a bath 9 containing an electrolyte 10 and a liquid metal 11. An electrochemically active cathode is formed by the liquid metal layer 11. An anode 12 has a support rod 13 which is attachable to an anode beam 14. The anode is supported in the bath 9, maintaining a spacing 15 between the anode and cathode. The anode beam 14 is movably supported from a rigid beam 16, and is movable over a distance A. The uppermost and lowermost positions are illustrated in phantom. Due to this large distance, the anode beam 14 is connected through a flexible conductor 17 to a cathode bar 18. A portable auxiliary beam (not shown) is used to raise the anode beam, with the distance A being typically more than about 25 cm, and usually about 40 cm. This large distance is required to avoid frequent stop-pages for repositioning the anode.

Figure 2:
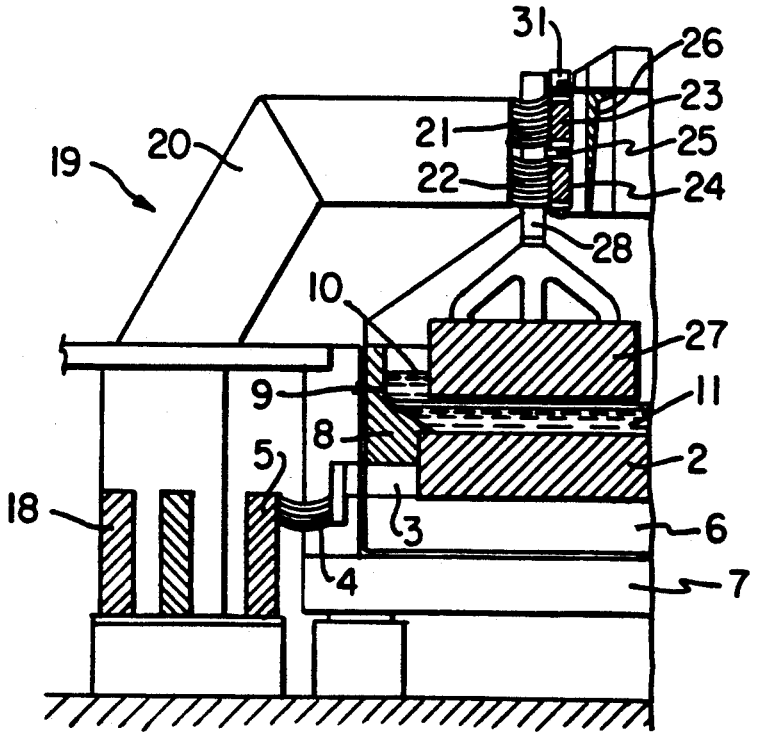
FIG. 2 is an illustrative view of an electrolysis cell of the present invention.

Referring to FIG. 2, the inventive electrolysis cell is shown. The electrolysis cell is similar to the prior art cell in terms of the cathode type, positioning, bath composition, etc., but differs by eliminating the need for the large flexible anode conductor 17 and also eliminates the single anode beam, minimizing beam travel.

Referring still to FIG. 2, an electrolysis cell 19 has a rigid anode riser 20 connected to a pair of flexible conductors 21 and 22. The pair of substantially shorter conductors are attached to a pair of anode beams 23 and 24, respectively. The anode beams are mounted one above another and are individually movable in a cycle first towards, then away, from each other. Both beams are interconnected by a spindle 25, with both anode beams supported by a rigid beam 26. An anode 27, similar to FIG. 1, is supported by an anode rod 28. However, the anode rod 28 is alternately attachable to one of the pair of anode beams.

Figure 3:
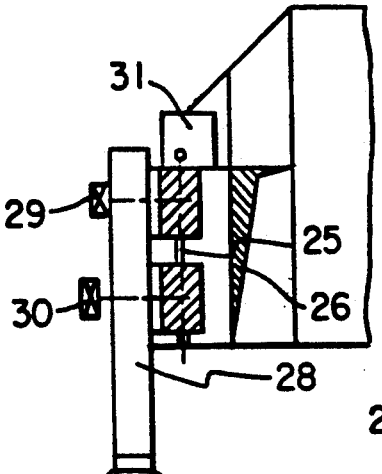
FIG. 3 is an enlarged partial cross-section view of the electrolysis cell of FIG. 2, illustrating alternate anode locking to dual anode beams.

Referring to FIG. 3, an enlarged sectional view of the dual anode beam system is shown. Each anode beam 23 and 24 has an associated anode locking device 29 and 30, respectively. Preferably, only if the anode bars are to be moved may the anode rods be fastened to only one of the two beams. In the inactive position the anode carbons may be fastened simultaneously to both beams. This simultaneous attachment offers the advantage of higher mechanical safety as well as lower voltage losses at the contact points. When adjustment is required only one device is activated at each time depending on which anode beam it is desired to be attached to. For example, in FIG. 3, the rod 28 is clamped by the devise 29 to the beam 23. A housing 31 covers a drive unit (not shown), which is mounted on the rigid beam 26. The drive unit engages the spindle 25 to effect movement of the anode beams.

Preferably, the drive unit is a geared spindle drive which is reversibly rotatable. A first gear placed on an end of the spindle, engages a second gear driven by a reversible motor. Stops could be positioned on the first gear which engage first and second limit switches, each of which, when contacted, changes the motor direction. Of course, there are numerous way of moving the pair of anode beams synchronously in the prescribed cycle, such as the use of individual hydraulic or electric piston actuators, eliminating even the need for an interconnecting spindle. Thus, any actuating/driving system which drives a pair of anode beams in the prescribed cycle may be used.

Figure 4:
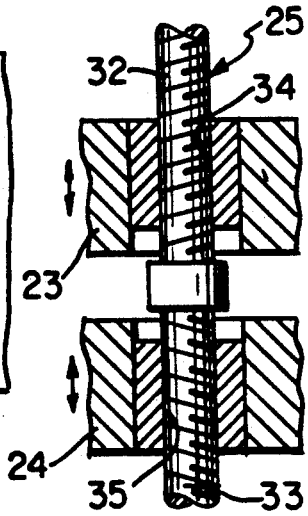
FIG. 4 shows an enlarged transverse view of the dual anode beam adjustment device.
Figure 4:
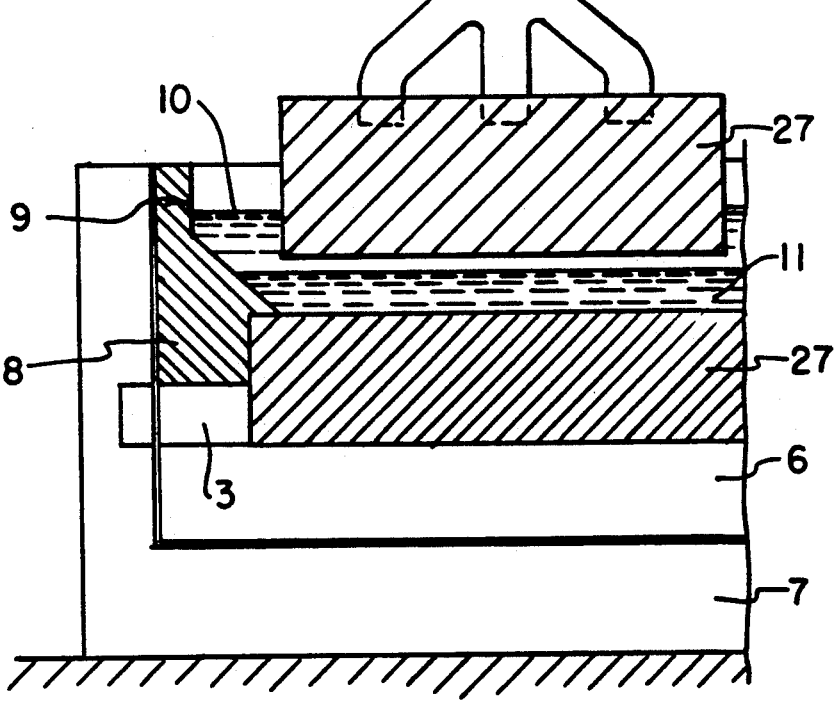

FIG. 4 illustrates the spindle 25 in cross section. The spindle passes through and interconnects the two anode beams 23 and 24. The spindle has two separated portions, an upper threaded portion 32 and a lower threaded portion 33, the upper portion threaded in a first direction and the lower portion threaded in the opposite direction. Thus one portion has "right hand" threads, while the other portion has "left hand" threads. Each anode beam has a threaded aperture, 34 and 35, respectively, with a matching thread taper for engaging a complimentary portion of the spindle. Thus, rotation of the spindle in a first direction will move the beams toward each other, and reversing the rotation will move them away from each other.

In FIG. 3, the anode beams are at their maximum displacement. At this point, the rod is attached to the upper beam 23, by the locking device 29, while the second locking devise 30 which cooperates with the lower beam 24, is left open. The spindle would then be rotated by the drive unit, such that the beams move towards each other, until a position of minimum displacement is reached.

Figure 5:
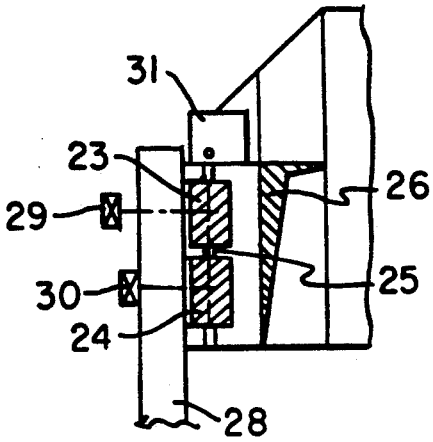
FIG. 5 is an enlarged partial view of the electrolysis cell of FIG. 2, illustrating alternate anode locking to the dual anode beams.

Referring to FIG. 5, the two beams are at their minimum displacement, at which point, the upper devise 29 is opened, while the lower devise 30 is closed, thus switching the rod so that the anode can continue in a downward direction, following the anode beam 24. Thus, one of the beams is always moving up while the other always moves down. Clamping to the appropriate beam at the appropriate time determines the direction of the anode.

Using the two oppositely moving anode beams, total displacement can be limited to about 5 cm. Thus, the clearance for movement in the anode flexible conductors can be kept small, minimizing the previously described detrimental effects. Also, a rigid riser 20 can be used in place of the long flexible conductors.

Deviations in individual anode spacing can be corrected easily with the present invention. First, with the geared spindle drive switched off, all the anodes are secured via the anode locks 30 to the lower anode beam 24, when it is at its uppermost position. Any anode carbon to be raised, rather than lowered, is temporarily attached to the upper anode beam 23 by the lock 29. Thereafter, the anode beam 24 is moved downward, e.g., 5 mm via rotation of the spindle 25. At the same time, the anode beam 23, with the anodes to be raised, moves upward, e.g., 5 mm. At that point, the raised anode is attached to beam 24, and the spindle direction reversed to continue raising the anodes, increasing the pole spacing of the anode by 10 mm. The raised anode's movement is then coordinated with the other anodes.

To decrease pole spacing, with the geared spindle drive switched off, all the anodes are attached to the upper beam 23. When the beam reaches its uppermost position, the anodes to be lowered remain attached to the anode beam 23, while all other anode rods are temporarily attached to the lower anode beam 24. Following this, the anode beam 23 is moved downward 5 mm. At the same time, the anode beam 24 with the remaining anode carbons moves upward 5 mm. Thereafter all the anodes are attached to the anode beam 24 before the latter is moved downward into the initial beam position. Following either the raising or lowering procedure, once the starting position is reached, the pole spacing of the chosen anode carbons has increased or decreased by 10 mm, while those not chosen have been both raised and lowered 5 mm, for a net change of zero.

Since anode consumption amounts to about 1.5 to 2 cm per day, a beam travel length of about 5 cm is sufficient for carrying out all conceivable lifting and lowering motions. The anode rods therefore can be made very short and the distance from the electrolysis bath can likewise be kept very small. This leads to a decrease in the overall height of the electrolysis cell.

An example of the anode locking devises using hydraulic clamping elements is shown in the attached FIG. 6.

Figure 6C:
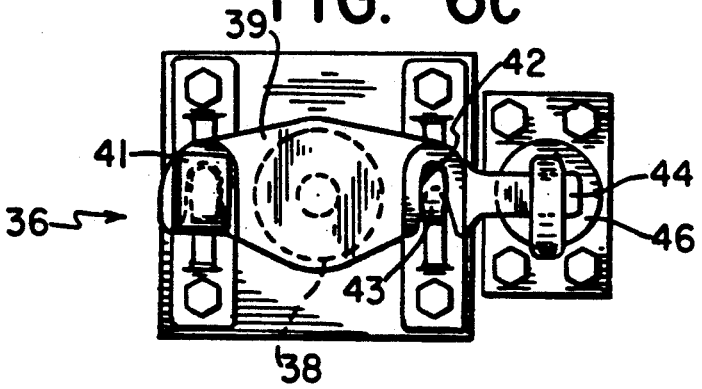
FIGS. 6*a*, *b* and *c* are enlarged views of an anode locking mechanism usable with the present invention.
Figure 6A:
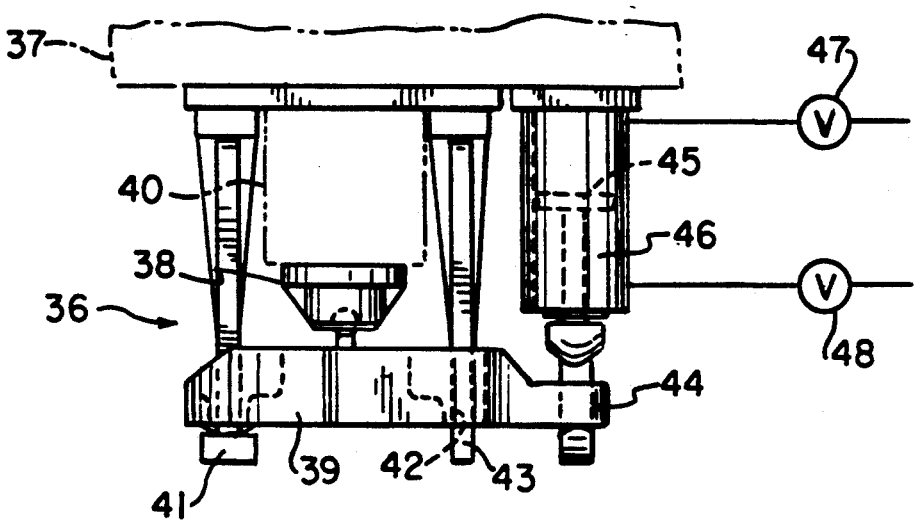
Figure 6B:
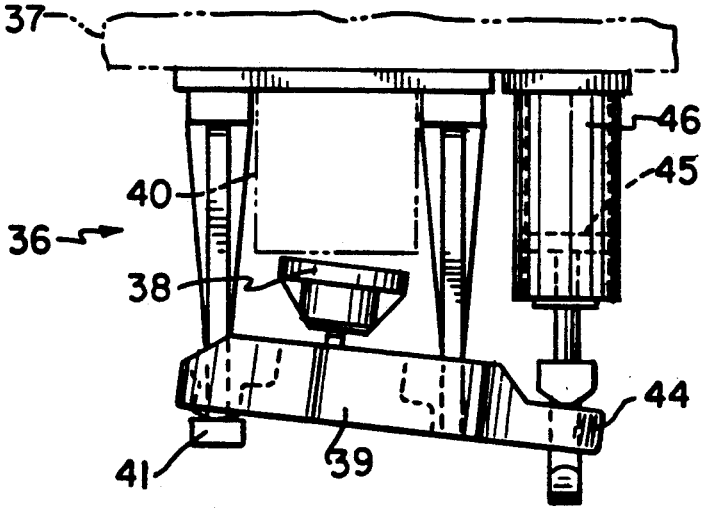

Referring to FIG. 6*a*, a top view of an anode locking devise 36 is shown. The devise 36 is attached to an anode beam 37 and has a clamp 38 supported on a latch 39, the clamp 38 being in engagement with an anode rod 40 (shown in phantom). The latch 39 is pivotally anchored at one end to a support 41, and has a slotted portion 42 slidable on a pin 43. A second latch end 44 is attached to a piston 45 which is reciprocally movable in a pressurizable cylinder 46. A pair of valves 47 and 48 are disposed on opposite sides of the piston to control pressurization. When the valve 47 is activated, the piston is pushed outwardly to open the lock (as shown in FIG. 6*b*). When the valve 48 is activated, the piston is pushed inwardly to close the lock (as shown in FIG. 6*a*). Referring to FIG. 6*c*, a front view of the anode lock is shown.

When necessary, the latch can be removed, for example, when individual anode carbons are burned out and must be replaced by new ones. When the change of anodes is carried out, both locks at the upper anode beam 23 and lower anode beam 24 are opened and the latches removed, so that the anode rod is free for removal.

Control of the valves is carried out by a process control microprocessor, or another control devise. Of course, any conventional system adaptable for controlling the reciprocal movement of the piston can be used. It should be understood that the discussed locking devises and associated control system are offered for exemplary purposes, and many other locking devises may be used with the present invention.

Using two anode beams according to the invention, the anode rods are given a quasi continuous downward movement so that the stopping, disconnecting, and repositioning using a portable auxiliary beam become unnecessary. The invention also eliminates the rise in the bath level by the simultaneous lowering and raising of one or more anodes, such that the additional bath melt volume displaced is compensated for by the volume of the anode carbons raised. Allowing adjustment of the anodes during operation assures optimum cell efficiency, while eliminating the need for stoppages to adjust the distance between poles. Consequently, cell efficiency is increased and the cell remains on-line for longer periods, increasing production capacity per cell.

The reduced lifting and lowering motion of the anode beams allows redesign of the cell for use of an essentially rigid anode riser at the anode/cathode connection, and to do without an auxiliary cross arm, which previously led to the expenditure of appreciable effort in the operation of each individual electrolysis cell. Moreover, the anode rods can be made much shorter, leading to an appreciable savings in anode weight and material.

While the invention is described in relation to an electrolysis cell for producing aluminum, it will be understood that any electrolysis cell could benefit from the present invention. The description of a spindle and drive combination for simultaneous raising and lowering of the anode beam was illustrative of one way to accomplish the effect desired and it will be understood that any means for providing the proper cycle for the dual anode beam system is within the scope of the present invention. Also, while movable anodes with fixed cathodes are discussed, it will be obvious that movable cathodes with or without movable anodes may also benefit from this invention.

We claim

1. An apparatus for adjusting the distance between the anodes and cathodes of an electrolysis cell, comprising:

a first movable anode beam, to which individual anodes are attachable, a second movable anode beam, disposed beneath the first anode beam, to which individual anodes are attachable, means for selectively attaching the individual anodes to either one of the first or the second anode beams, dependent on the direction in which the individual anode is to be moved, and means for moving the anode beams relative to each other, the beams being synchronously movable in a first direction towards each other and in a second direction away from each other, such that the selectively attached anodes are raised or lowered as desired.

2. The apparatus of claim 1, wherein the anodes have anode rods which extend from anode blocks, the anode rods being attachable to the selected anode beam.

3. The apparatus of claim 1 wherein the means for attaching the anodes to the beams are mechanically, hydraulically or pneumatically actuated devices actuatable in response to a control unit.

4. The apparatus of claim 3 wherein the means for attaching the anodes to the beams comprise a latch engagable with the anode rod, the latch being pivotably anchored at a first end to a support and having a slotted portion, a pin, extendable from an anode beam on which the slotted portion is slidable, a piston attached to a second latch end, the piston reciprocally movable in response to a control signal for moving the latch into and out of engagement with the anode.

5. The apparatus of claim 1 wherein the means for moving the anode beams comprise a spindle having two separated portions, an upper threaded portion and a lower threaded portion, the upper portion threaded in a first direction and the lower portion threaded in the opposite direction, each anode beam having a threaded aperture having a matching thread for engaging a complementary portion of the spindle.

6. The apparatus of claim 5 further comprising a drive unit for rotating the spindle in response to a control signal.

7. The apparatus of claim 1 wherein the means for moving the anode beams comprise a pair of piston actuators, each actuator driving a respective anode beam in a prescribed cycle.

8. A method for adjusting the distance between the anodes and a cathode in an electrolysis cell having:

a first movable anode beam, to which individual anodes are attachable, and a second movable anode beam, disposed beneath the first anode beam, to which individual anodes are attachable, said method comprising:

selectively attaching the individual anodes to either one of the first or the second anode beams, dependent on the direction in which the individual anode is to be moved, and moving the anode beams relative to each other, the beams moving synchronously in either a first direction towards each other, such that the anodes attached to the first beam move downwardly while the anodes attached to the second anode beam move upwardly, or in a second direction away from each other, such that the anodes attached to the first beam move upwardly while the anodes attached to the second anode beam move downwardly.

9. The method of claim 8 further comprising detaching the anodes, after the first anode beam has reached its lowest position in the first direction, from the first anode, beam and attaching them to the second anode beam, to provide a continuous lowering motions.

10. The method of claim 8, further comprising, after one of the anode beams has reached its lowest position, detaching the anode from one anode beam and attaching it to the other anode beam when the latter has reached its upper end position, prior to the beams changing from the first to the second direction.

11. The method of claim 8, further comprising, simultaneously with the lowering of an individual anode, raising the other anodes, by connecting them to the anode beam which is moving upwardly.

12. The method of claim 8, further comprising stopping the motion of the anode beams when changing over the anodes from the first anode beam to the second anode beam.

13. The method of claim 8, wherein each anode beam travels about 5 cm in either direction.

* * * * *